US005769414A

United States Patent [19]

Feche et al.

[11] Patent Number: 5,769,414

[45] Date of Patent: Jun. 23, 1998

[54] GOLF CLUB

[75] Inventors: Pierre Feche; Jean-Michel Bouque, both of Cran-Gevrier, France

[73] Assignee: Taylor Made Golf Company, Inc., Carlsbad, Calif.

[21] Appl. No.: 491,442

[22] Filed: Jun. 16, 1995

Related U.S. Application Data

[63] Continuation of Ser. No. 961,619, Oct. 16, 1992, abandoned.

[30] Foreign Application Priority Data

Oct. 16, 1991 [FR] France ..... 91 12936

[51] Int. Cl.[6] ..... A63B 53/14

[52] U.S. Cl. ..... 273/81 R; 273/81 A

[58] Field of Search ..... 273/80 R, 81 R, 273/81 B, 81 C, 81 D, 81.2, 81.3, 81.4, 81.5, 81.6, 67 DB, 75, 81 A

[56] References Cited

U.S. PATENT DOCUMENTS

| | | | |
|---|---|---|---|
| 1,012,299 | 12/1911 | True | 273/81 R |
| 1,648,175 | 11/1927 | Hamel | 273/81 R |
| 1,890,037 | 12/1932 | Johnson | 273/81 R |
| 3,075,768 | 1/1963 | Karns | 273/81 A |
| 3,606,326 | 9/1971 | Sparks | 273/75 |
| 4,597,578 | 7/1986 | Lancaster | 273/81 R |

FOREIGN PATENT DOCUMENTS

| | | | |
|---|---|---|---|
| 2182252 | 5/1987 | United Kingdom | 273/81 R |
| 2192550 | 1/1988 | United Kingdom | 273/81 R |

*Primary Examiner*—Sebastiano Passaniti
*Attorney, Agent, or Firm*—Pollock, Vande Sande & Priddy

[57] ABSTRACT

Golf club comprising a shaft incorporating, at its lower end, a head and, at its upper end, a grip which is light and constituted by a peripheral tubular wall.

9 Claims, 5 Drawing Sheets

GOLF CLUB

This application is a continuation of application Ser. No. 07/961,619 filed Oct. 16, 1992 now abandoned.

FIELD OF THE INVENTION

The present invention concerns a golf club and, more specifically, an improvement made to its grip.

BACKGROUND OF THE INVENTION

When the game of golf is played, the golfer hits his ball to move it, by driving it with an instrument called a golf club, which is constituted by what is called in English a shaft incorporating a head at its lower end, while its upper end is equipped with a handle, often called by its English name, i.e., a "grip."

The golf club is a hitting instrument in which the golfer must have absolute confidence. An unsatisfactory feeling before, during, and after impact causes the golfer to lose confidence in the equipment. It must also be remembered that, for a determinate weight of the club head, the blow will be more accurate, and the distance travelled by the struck ball will be greater, if the weight distribution is such that the overall center of gravity of the club is close to the point of impact of the head on the ball. It will easily be understood why it is advantageous to reduce the weight as much as possible in the upper part of the club and to improve and augment the sensations perceived through the hands of the golfer, which act as feelers in transmitting information relating to the golf club.

Some manufacturers have already tried to find solutions, but these are merely attempts, and the problem has been only partially solved. In fact, some manufacturers have made grips by winding a strip in a spiral on the upper part of the shaft. This solution is not satisfactory, however, since, while the problem of weight reduction is solved, other equally-important characteristics suffer. In fact, applying this solution reduces the comfort and feel of the golf club all the more when the winding comprises extra thickness.

SUMMARY OF THE INVENTION

The purpose of the present invention is thus to solve these problems by proposing a golf club comprising a shaft incorporating a head at its lower end and a grip at its upper end, in which the grip is light and is formed by a peripheral tubular wall.

The grip thus has a weight less than the weight of conventional grips, e.g., less than 35 grams, and is made of a flexible, low-density elastomer material.

According to one embodiment, the tubular peripheral wall is cylindrical; however, according to another advantageous embodiment, it is conical.

The peripheral tubular wall is of substantially uniform thickness, i.e., of between 1 and 2.5 millimeters, and comprises a transverse end wall This provides sufficient resistance while also being comfortable and allowing the golfer to have the correct feel of the shaft.

BRIEF DESCRIPTION OF THE DRAWINGS

Other features and advantages of the invention will emerge from the following description provided with reference to the attached drawings supplied solely by way of example.

DESCRIPTION OF THE PREFERRED EMBODIMENTS

Figure 1:
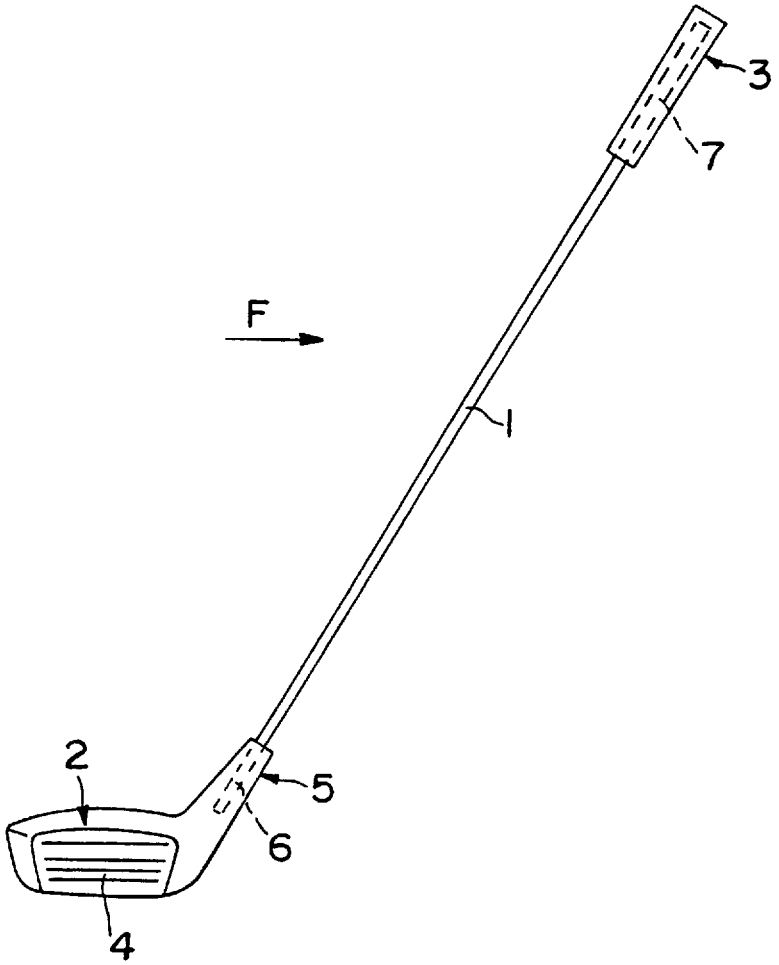
FIG. 1 is a front view of a golf club according to the invention.
Figure 2:
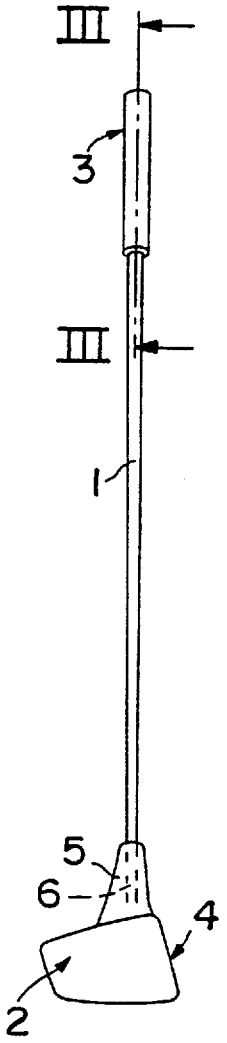
FIG. 2 is a side view as seen from direction F in FIG. 1.

FIGS. 1 and 2 represent a golf club according to the invention. This golf club comprises, in conventional fashion, a shaft 1 which incorporates a head 2 at its lower end, while its upper end comprises a grip 3. These three basic components, conventionally known, are not described in detail. However, it should be noted that the head 2 comprises a hitting surface 4 designed to strike the ball in order to drive it, and a neck 5 in which the lower part 6 of the shaft 1 is embedded. It should also be indicated that the head may have different shapes depending on the type of club, each manufacturer offering similar, but not identical, general shapes for a given type of club. FIGS. 1 and 2 illustrate a "wood," but it is understood that the invention applies equally well to irons and putters.

The shaft 1 of the club is constituted by a tube made of a metal alloy or composite material, so as to impart to it a determinate stiffness and well-defined flexion and torsion properties. The head 2 is made of wood, a metal alloy, aluminum, or a composite material.

When striking the ball, the golfer holds the club by the grip 3 with two hands. To this end, the grip is placed on the upper part 7 of the shaft 1 and, according to the invention, the grip is light so that, for a club having a given weight, the maximum amount of weight can be placed in the head. "Light" signifies, of course, a minimal weight, or at the least a weight less than that of a conventional grip. Thus, the weight of the grip may be less than 35 grams, e.g., between 25 and 35 grams. The grip 3 may advantageously weigh approximately 30 grams. It is made, for example, of a flexible, low-density elastomer-based material in order to transmit to the golfer all of the feel of the game, while remaining comfortable.

Figure 3:
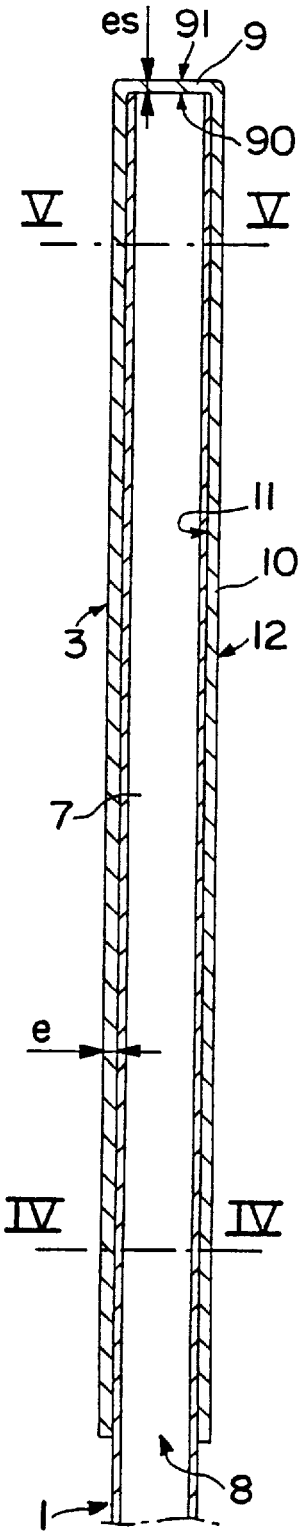
FIG. 3 is an enlarged view of the upper end of the club, in cross-section along line III—III in FIG. 2.
Figure 5:
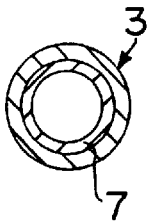
FIGS. 4 and 5 are transverse cross-sections along lines IV—IV and V—V, respectively, in FIG. 3.
Figure 4:
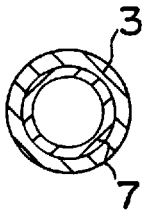
Figure 6:
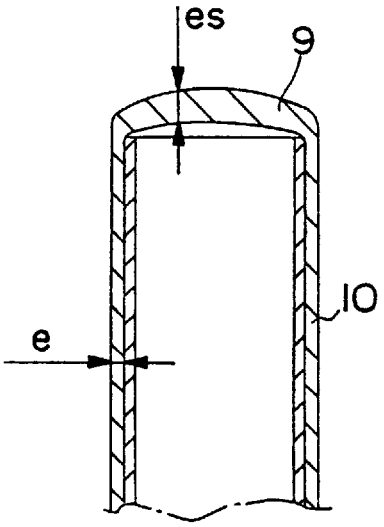
FIG. 6 is a view similar to that in FIG. 3, but is partial and illustrates a second embodiment.

FIG. 3 illustrates a first embodiment according to the invention, in which the grip has the shape of a tube 8 opening downward and closed at the top by an upper transverse wall 9. The peripheral tubular wall 10 of the grip 3 is formed in a single piece, e.g., by molding, and is limited internally by an inner surface 11 and an outer surface 12. According to a preferred embodiment, the thickness e of the tubular wall 10 is uniform and ranges, for example, between 1 and 2.5 mm so as to impart to it both the required lightness, and comfort and sensation-transmitting properties. In this embodiment, the thickness es of the transverse end wall 9 is substantially equal to the thickness e of the peripheral tubular wall. However, to give the grip greater end strength, the upper transverse wall 9 may have a thickness es greater than the thickness e of its tubular wall, as shown in FIG. 6.

Figure 7:
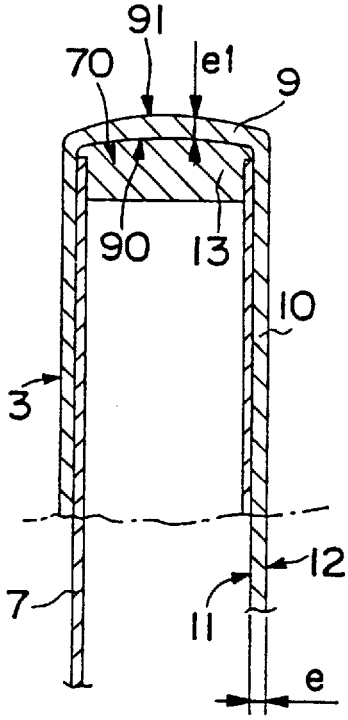
FIG. 7 is a view similar to that in FIG. 3 illustrating a third embodiment.

FIG. 7 illustrates a variant in which, to strengthen the transverse wall and to ensure that it is supported at the bottom so as to prevent any potential perforation, an end plug 13 made of a plastic material is fitted on the upper end 70 of the shaft 1.

According to the variants shown in FIGS. 3 to 7, the end of the shaft 1 and the tubular wall 10 of the grip 3 are substantially cylindrical.

Figure 8:
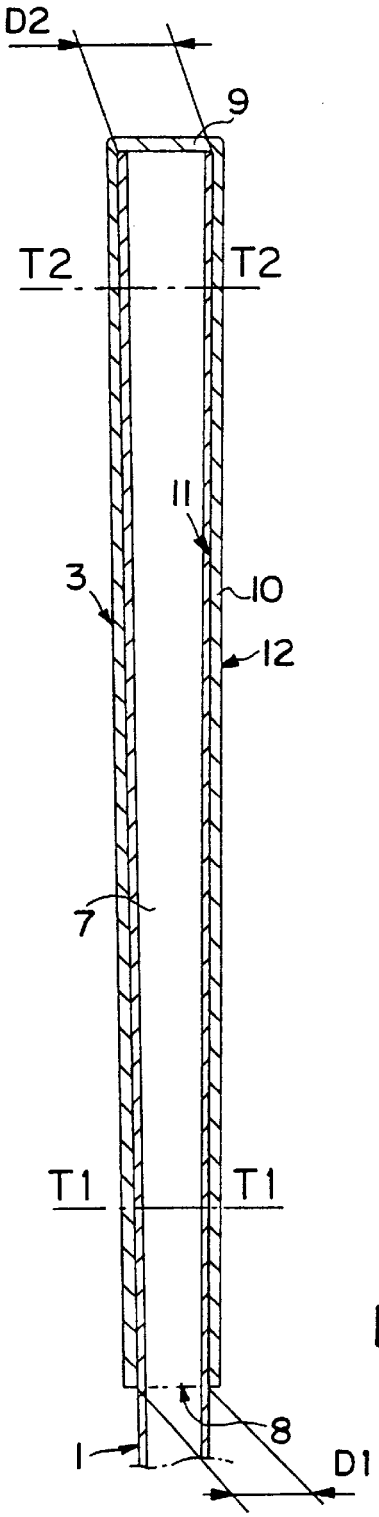
FIGS. 8, 9, and 10 are views similar to FIG. 3 illustrating further embodiments.
Figure 8B:
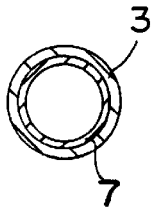
FIGS. 8*a* and 8*b* are transverse cross-sections lines T1—T1 and T2—T2, respectively, in FIG. 8.
Figure 8A:
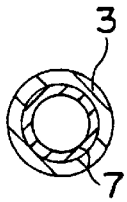
Figure 9:
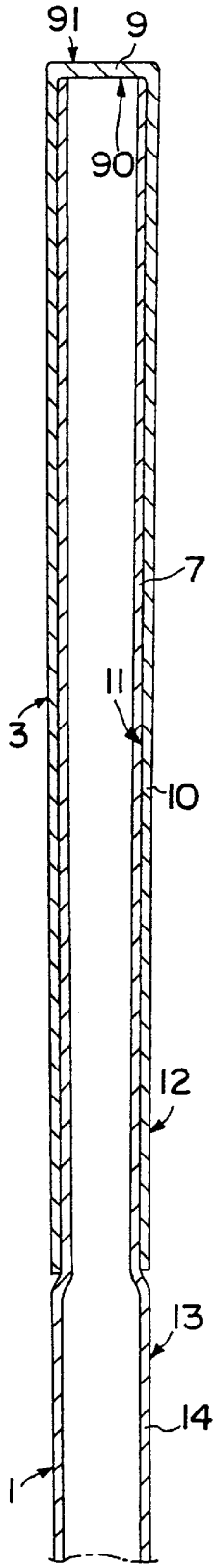
Figure 10:
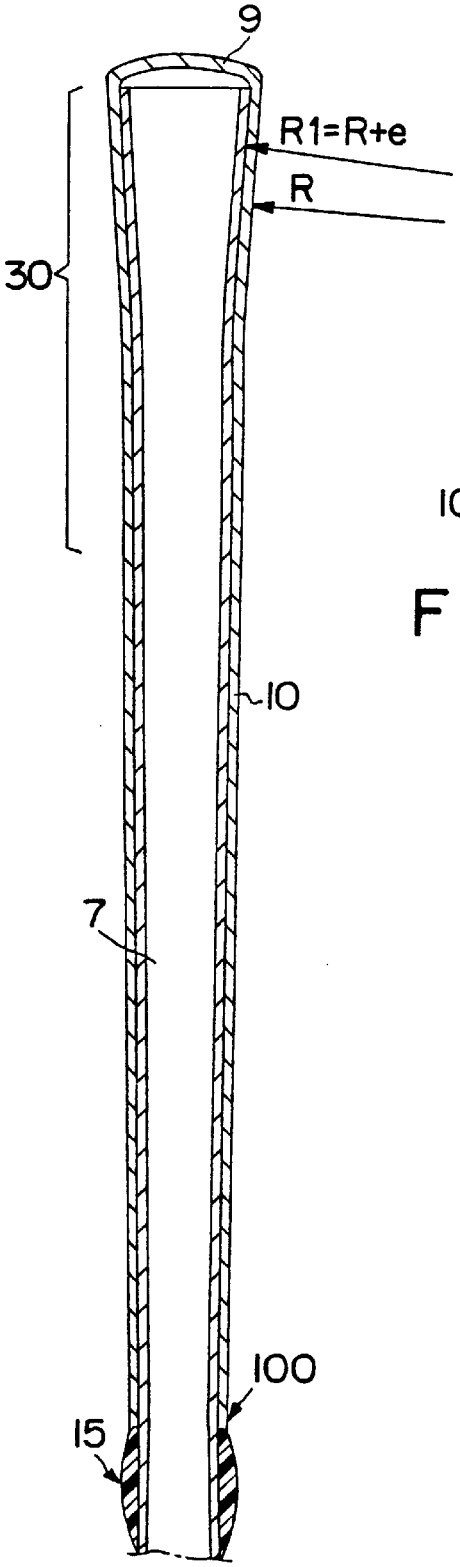

According to other preferred configurations of the invention illustrated in FIGS. 8 to 10, the end 7 of the shaft 1 has a constantly-increasing diameter and the tubular wall 10 having uniform thickness e is conical, so that the lower inner diameter D1 increases gradually in an upward direction so as to reach an upper inner diameter D2.

According to another embodiment shown in FIG. 9, the outer surface 12 of the grip falls substantially within the extension of the outer surface 13 of the median wall 14 of the shaft 1.

Figure 11A:
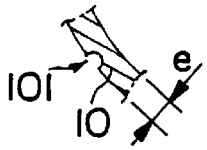
FIG. 11*a* is a cross-section along line XI—XI in FIG. 11.
Figure 11:
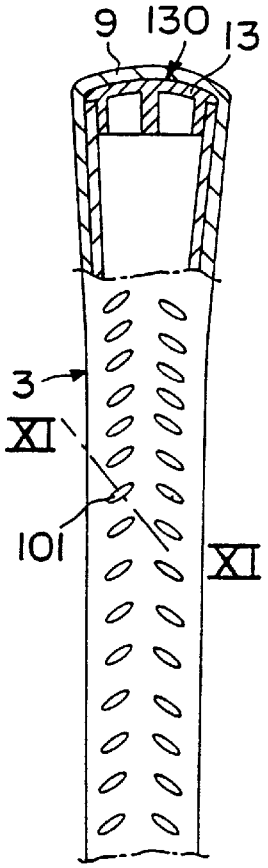
FIG. 11 is a view similar to that in FIG. 10 illustrating a variant of FIG. 10.

The transverse end wall 9 may have a flat outer surface 91, as shown in FIGS. 8 and 9; however, as shown in FIGS. 6, 10, and 11, it may be rounded.

FIG. 10 illustrates another variant in which the tubular wall 10 of the grip incorporates, over a portion of its length, and in particular its upper portion 30, a curved portion which widens as it extends upward. Thus, the outer surface 12 is generated by a generating line having radius R, while the inner surface 11 is generated by a generating line having radius R1=R+e.

FIG. 11 illustrates a variant of a grip 3 for a golf club, in which, at the end 70 of the shaft 1, a reinforcing wall 130 for the transverse end wall 9 is formed. As shown in the variant in FIG. 7, this reinforcing wall is constituted by a plug 13 made of a rigid plastic material and acting as support for the transverse end wall 9, thus strengthening it.

Figure 12:
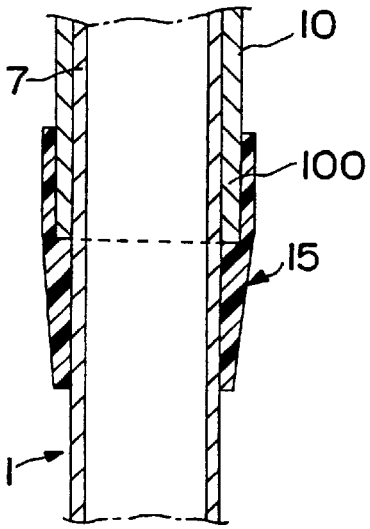
FIG. 12 is a partial view illustrating a detail.

According to an advantageous arrangement illustrated in FIGS. 10, and 12, a circular finishing, protective ring 15 is provided at the base of the grip 3. This ring surrounds the shaft and is made of a plastic or elastomer material. It advantageously covers peripherally the lower end 100 of the peripheral wall 10 of the grip, as shown in FIG. 12 (partial view). The lower peripheral covering arrangement makes it possible to protect the lower end of the grip 3. In the variant illustrated in FIG. 10, the protective ring 15 does not cover the lower part of the grip, but is only placed against the latter without covering it. Its thickness, which is substantially identical to or slightly greater than that of the lower end 100, protects the lower end against blows and tearing.

According to another arrangement, the grip comprises externally a succession of hollowed shapes 101 making it possible to hold the club better, as shown in FIGS. 11 and 11*a*.

Figure 13:
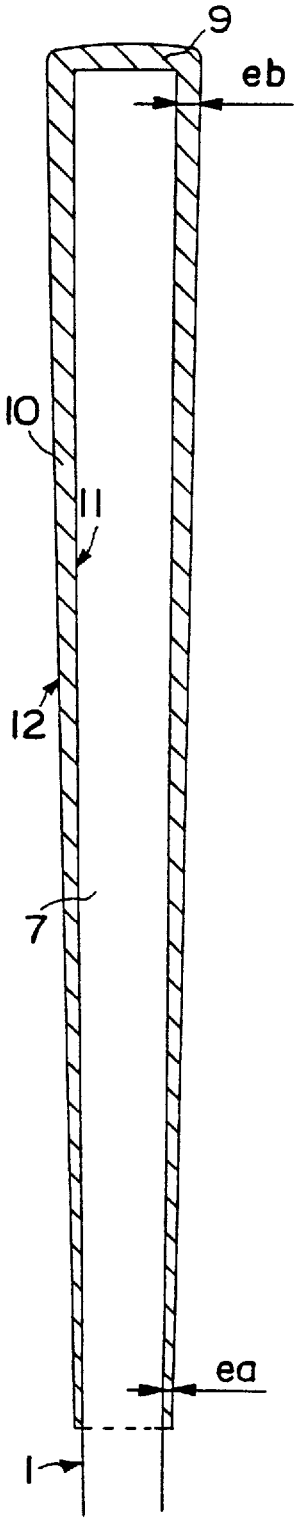
FIGS. 13 and 14 illustrate other variants.

As has been previously described, the thickness e of the peripheral wall is uniform or substantially uniform. This means that its thickness e in the lower portion of the wall is equal, or substantially equal, to its thickness e in its median, upper part. This means that its thickness is uniform, or substantially uniform, at whatever spot this thickness is measured. This embodiment is preferred because it allows all parts of the hands in contact with the club to have the same sensation and the same touch and sensibility of the club. However, one would remain within the scope of the invention if the case were otherwise, as shown in FIG. 13, in which the thickness e of the wall varies as it increases gradually from one thickness ea in its lower portion to a larger thickness eb in its upper portion.

Figure 14:
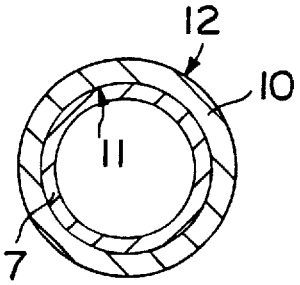

Similarly, the inner surface 10 of the peripheral wall is cylindrical and concentric with its outer surface 11, which is also cylindrical. Accordingly, in a transverse cross-section of the grip, as shown in FIGS. 4, 5, 8*a*, and 8*b*, the peripheral thickness is uniform. However, the case may be different, as illustrated in FIG. 14.

What is claimed is:

1. A golf club comprising:

(a) a shaft with a lower end and an upper end;

(b) a head attached to said lower end; and (c) a grip constituted by a peripheral tubular wall attached to said upper end, said grip having a weight of less than 35 grams and being made of a low-density elastomer and said peripheral tubular wall having a substantially uniform thickness (e) comprised between 1.0 and 2.5 millimeters;

(d) wherein said grip has an outer surface which falls substantially within an extension of an outer surface of a median wall of said shaft.

2. A golf club according to claim 1, wherein said grip weighs between 25 and 35 grams.

3. A golf club according to claim 2, wherein said grip weighs approximately 30 grams.

4. A golf club according to claim 1, wherein said peripheral tubular wall is cylindrical.

5. A golf club according to claim 1, wherein said peripheral tubular wall is conical.

6. A golf club according to claim 1, wherein said grip comprises a transverse end wall.

7. A golf club according to claim 6, wherein said transverse end wall has a thickness (e1) substantially equal to said thickness (e) of said tubular cylindrical wall.

8. A golf club according to claim 1, wherein said shaft comprises an end plug.

9. A golf club according to claim 1, comprising a finishing protective ring located at a base of said grip and surrounding said shaft.

* * * * *